US005475881A

United States Patent [19]

Higgins et al.

[11] Patent Number: 5,475,881

[45] Date of Patent: Dec. 19, 1995

[54] SLEEP ENHANCING POSTURIZED MATTRESS AND MATTRESS COVER

[75] Inventors: Larry Higgins, Carthage; Earl W. Kennedy, Joplin, both of Mo.

[73] Assignee: L&P Property Management Company, Chicago, Ill.

[21] Appl. No.: 237,278

[22] Filed: May 3, 1994

Related U.S. Application Data

[63] Continuation-in-part of Ser. No. 93,384, Jul. 19, 1993, which is a continuation-in-part of Ser. No. 905,085, Jun. 24, 1992, Pat. No. 5,231,717, which is a continuation-in-part of Ser. No. 397,660, Aug. 23, 1989, abandoned.

[51] Int. Cl.[6] ..... A47C 31/02

[52] U.S. Cl. ..... 5/470; 5/499; 5/501

[58] Field of Search ..... 5/470, 471, 499, 5/500, 501

[56] References Cited

U.S. PATENT DOCUMENTS

| | | | |
|---|---|---|---|
| 1,892,913 | 1/1933 | Timm | 5/470 |
| 2,399,628 | 5/1946 | Cunningham | 5/470 |
| 2,975,437 | 3/1961 | Freeman | 5/471 |
| 3,287,749 | 11/1966 | Marisco . | |
| 3,504,387 | 4/1970 | Hummel | 5/499 |
| 4,055,866 | 11/1977 | Evans | 5/911 |
| 4,388,738 | 6/1983 | Wagner | 5/470 |
| 4,463,466 | 8/1984 | May et al. . | |
| 4,662,012 | 5/1987 | Torbet . | |
| 4,922,564 | 5/1990 | Thomas | 5/470 |
| 4,955,095 | 9/1990 | Gerrick | 5/470 |
| 4,982,466 | 1/1991 | Higgins et al. . | |
| 4,999,868 | 3/1991 | Kraft . | |
| 5,117,519 | 6/1992 | Thomas | 5/500 |
| 5,285,542 | 2/1994 | West et al. | 5/500 |

FOREIGN PATENT DOCUMENTS

| | | | |
|---|---|---|---|
| 495132 | 12/1951 | Italy | 5/470 |

*Primary Examiner*—Michael J. Milano
*Attorney, Agent, or Firm*—Wood, Herron & Evans

[57] ABSTRACT

A zoned posturized mattress which is longitudinally zoned to have at least three, and preferably four, zones of differing resistance to vertical deflection over the surface of the mattress comprises a resilient mattress core and a unique mattress cover. The mattress cover includes a covering topper pad so constructed as to permit the direct application of and distribution of pressure from atop the mattress through the covering topper pad and into the resilient core without significant distortion of that pressure or weight and particularly without distortion which is normally caused by hammocking of the fabric or covering pad.

19 Claims, 3 Drawing Sheets

SLEEP ENHANCING POSTURIZED MATTRESS AND MATTRESS COVER

RELATED APPLICATIONS

This application is a Continuation-In-Part application of application Ser. No. 08/093,384, filed Jul. 19, 1993 still pending, which is, in turn, a Continuation-In-Part application of application Ser. No. 07/905,085, filed Jun. 24, 1992 now issued as U.S. Pat. No. 5,231,717, which is, in turn, a Continuation-In-Part application of application Ser. No. 07/397,660, filed Aug. 23, 1989 now abandoned.

BACKGROUND OF THE INVENTION

This invention relates to a bedding system, and more particularly, to an improved bedding mattress core and mattress cover for maximizing the restfulness of sleep of a person sleeping atop the mattress.

The quality of a person's sleep and the rest derived from that sleep is dependent upon the comfort of the person reclining atop a sleeping surface. One way in which this comfort can be measured is by the number of movements a person makes over the course of a normal night's sleep. Two factors which have been shown to affect comfort on a mattress are the mounts of pressure applied by the mattress to the body and the support characteristics of the mattress. When a healthy sleeper becomes "uncomfortable", either consciously or subconsciously, they move to relieve the discomfort. This discomfort can come from excessive pressure on the body or improper support from the mattress.

During the night, a healthy person usually goes through approximately four to six sleep cycles. These sleep cycles consist of both REM and non-REM sleep. Non-REM sleep is generally divided into stages I and II, which are light sleep, and stages III and IV which are deep sleep. All levels of sleep are important, but it is during stages III and IV that we get our deepest and most restful sleep.

When a sleeper moves or undergoes a major postural shift, the sleeper arouses to a lighter level of sleep or awakens. If the event of awakening is short in duration, it is often referred to as a transient arousal. The more awakenings and transient arousals which occur in a night or a sleep cycle, the less restful the sleep. Therefore, the more discomfort a sleeper feels during the night, the more that sleeper will move and the more awakenings and transient arousals will occur which will result in less restful sleep.

A perfect mattress, or sleep surface, would eliminate all awakenings or transient arousals associated with discomfort caused by excessive pressure or improper support. In fact, sleep studies have shown that when a person is reclining atop a mattress and mattress cover made in accordance with the invention of this application, it will substantially reduce the amount of pressure exerted on the body from the mattress and provide optimum support.

In Torbet U.S. Pat. No. 4,662,012, and in U.S. Pat. No. 4,982,466, there are disclosed multiple zone, constant zone pressure, air mattresses for supporting a person in a reclining position while maintaining minimal supporting body surface pressures. To that end, the mattresses disclosed in both of the above-identified patents utilize zones of differing, but constant air pressure along the length of the mattress, with the pressures in each zone being maintained constant even with body shifts on the mattress. This is in contrast to conventional non-zoned mattresses which maintain a common and constant degree of firmness or resistance to vertical deflection over the whole surface area and for the full length of the mattress, but which change pressures in response to varying loads as a person shifts position on the mattress.

Experimentation has now shown that a mattress should be divided into at least three, and preferably four, longitudinal zones of differing firmness or resistance to vertical deflection in order for the body of a person reclining atop the mattress to be supported with minimal pressures at the high pressure points on the body when lying on either their back or side. This is achievable only when the mattress is divided into at least three, and preferably four, longitudinal zones, each having a different level of resistance to vertical deflection.

But even when a mattress is properly zoned throughout its length, there is a problem of transmitting loads of a person's weight from atop the mattress through mattress covering material to the underlying zone mattress core. Typically, mattresses are covered with layers of fibrous matting which are, in turn, covered with an outer layer of material commonly known in the bedding industry as "ticking". The ticking is generally applied in three sections, the sections being a top panel, a bottom panel, and a side panel. The three panels are sewn together on the mattress unit with the top and bottom panels being physically attached to the mattress core. More recently, the fibrous matting material which was positioned on top of the mattress core has been replaced by unitary pads or so-called "topper pads" of resilient material such as polyurethane foam, sandwiched between quilted layers of woven fabric. Such a mattress topper pad is shown, for example, in U.S. Pat. No. 4,463,466. But whether conventional fibrous pads or topper pads are placed atop the mattress core, there is the problem of transmitting pressures and weights supported by the mattress core from the body of the person resting atop the mattress through to the core without a distortion of those pressures by the ticking or covering material. Unless the ticking is just lying loosely atop the mattress core, which would create an unsightly mattress, the tendency is for the ticking to hammock when supporting a body and to cause the majority of the pressure and weight of a person atop the mattress to be supported from the hammocked ticking, thereby creating excessive body surface pressures. This excessive body surface pressure is derived from the hammocked ticking or topper pad, which because it is carrying a substantial portion of the body weight, distorts the pressure from what the mattress core would experience in the absence of the hammocked ticking or covering material. And this distortion results in even perfectly zoned mattresses, imparting excessive pressure to selected parts on a body resting atop the mattress.

It has therefore been an objective of this invention to provide a zoned mattress core and cover which includes a covering material and which is capable of supporting a body with minimal supporting surface pressures at any point on the body.

It has been another objective of this invention to provide an improved zoned mattress core and cover for supporting a person reclining atop the mattress with minimal supporting surface pressures at any point on the body.

Still another objective of this invention has been to provide an improved zoned mattress core and cover for enhancing the sleep and minimizing the transient arousals of a person sleeping atop the mattress.

Still another objective of this invention has been to provide an improved mattress cover including a topper pad which increases sleeper comfort and which maintains and thereby enhances posturization of a posturized or zoned mattress core.

SUMMARY OF THE INVENTION

The invention of this application which accomplishes these objectives comprises a zoned mattress core which is longitudinally zoned so as to have at least three, and preferably four, zones of differing resistance to vertical deflection over the surface of the mattress. These zones comprise upper body, waist, lower body, and leg supporting zones, with the waist zone being the most firm, the lower body zone being the next most firm, the upper body zone being the third most firm, and the leg supporting zone the least firm. In accordance with the invention of this application, the zoned mattress core is covered by a mattress cover including a covering topper pad so constructed as to permit the direct application of and distribution of pressure from atop the mattress through the covering pad and into the core without significant distortion of that pressure or weight, and particularly without distortion which is normally caused by hammocking of the fabric or covering pad.

One specific mattress cover employed in the practice of this invention comprises a topper pad including a top fabric layer or ply covering a cushioning material and connected via an accordion pleat or fold to the side panel of the mattress cover. Between the bottom of the covering topper pad and the top of the mattress core there is an elasticized fabric which is connected to the inner edge of this accordion pleat. This elasticized fabric ply is capable of stretching in at least two mutually perpendicular directions, and preferably capable of being stretched in any direction. This construction of the mattress cover enables the non-stretchable top fabric layer or ply of ticking of the cover to fold inwardly when a load or force is applied atop the mattress cover while the elasticized fabric stretches. Thereby, load or weight is transferred through the cushioning topper pad or cover into the posturized mattress without the cover imparting any support to the load or weight. As a result, there is no hammocking of the covering materials relative to the mattress core and there is no high body surface pressure imparted to the body by hammocked ticking or covering material. Thus, the posturizing of the mattress core and the comfort of the mattress is maintained by the cushioning covering materials rather than being impaired or effectively destroyed by the covering materials.

BRIEF DESCRIPTION OF THE DRAWINGS

These and other objects and advantages of this invention will be more readily apparent from the following description of the drawings in which.

DESCRIPTION OF THE PREFERRED EMBODIMENTS

Figure 2:
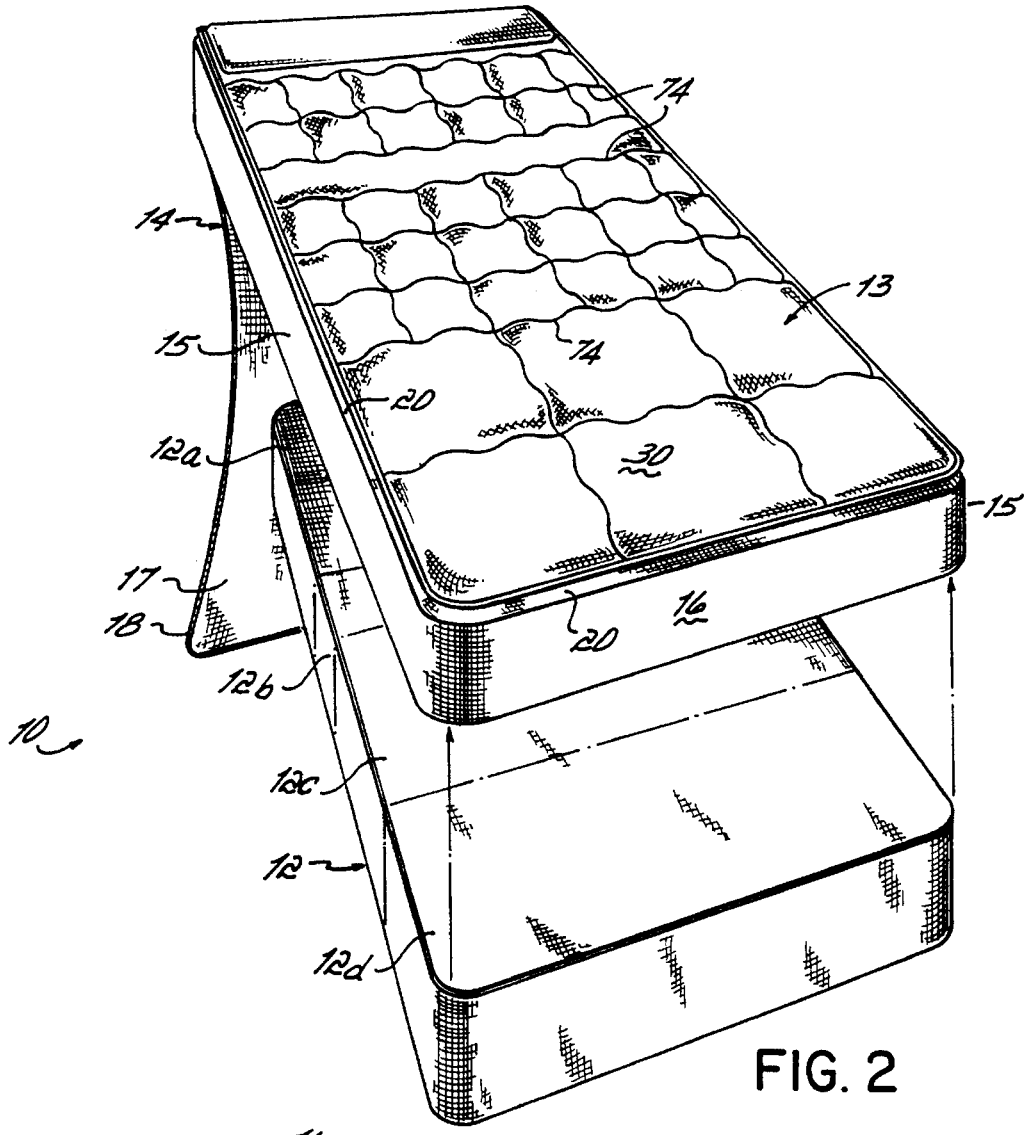
FIG. 2 is an exploded perspective view of the mattress of FIG. 1.
Figure 1:
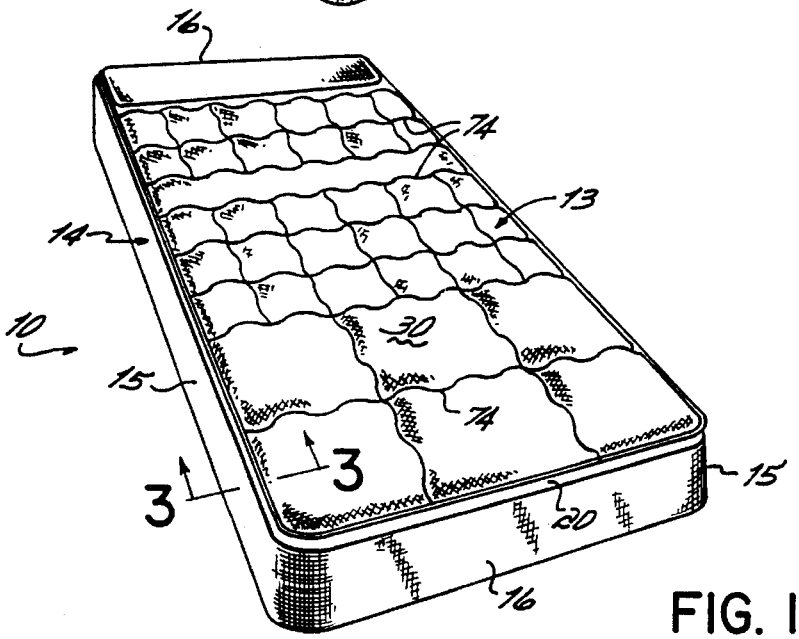
FIG. 1 is a perspective view of a mattress incorporating the invention of this application.

With reference to the drawings, a mattress 10 embodying the invention of this application, comprises a mattress core 12 and a mattress cover 14. The mattress cover 14 includes a topper pad 13 as well as padded side panels 15, end panels 16, and an unpadded bottom panel 17. The bottom panel 17 is preferably secured to the bottom edges of the side and end panels 15 and 16, respectively, by a zipper 18 such that the mattress cover 14 may be easily removed from the mattress core 12 to facilitate cleaning of the cover or inversion of the mattress core relative to the cover.

The mattress core 12 may be an air mattress core such as disclosed in U.S. Pat. No. 4,982,466, or it may be a foam mattress core, or it may be a metal spring mattress core. But in any event, whether made as a fluid filled bladder-type mattress core, or a foam mattress core, or a metal spring mattress core, it is longitudinally divided into at least three, and preferably four, longitudinal zones 12*a*–12*d* of differing firmness characteristics.

These zones 12*a*–12*d* in the illustrated four-zone core are of four different firmnesses (i.e., resistance to vertical deflection). These four zones comprise an upper body zone 12*a* which extends for approximately 5/15 the overall length of the mattress, a waist zone 12*b* which is approximately 1/15 the length of the mattress, a hip zone 12*c* which is approximately 4/15 the length of the mattress, and a leg or foot zone 12*d* which is approximately 5/15 the overall length of the mattress.

The zones 12*a*–12*d* of the mattress are of substantially differing firmness with the waist zone 12*b* being substantially more firm (firmness A) than the other zones. The upper body zone 12*a* (supports head and shoulders) is the next most firm (firmness B). The hip zone 12*c* is the next most firm (firmness C), and the leg zones 12*d* is the least firm (firmness D). The hip and leg zones will hereinafter be referred to collectively as the lower body zone. If the mattress core 12 is a spring core, these differing firmnesses of the differing zones of the mattress result from springs of differing characteristics within each of the zones. These differing firmnesses may be the result of differing gauge wire utilized to manufacture the springs in each zone or of differing styles of coils. Alternatively, the springs may be made of differing composition wire.

If the mattress core 12 is a foam mattress core in which the resiliency of the mattress is imparted by the resiliency of the foam material, then differing firmness foam materials are utilized in the differing zones to achieve the same relative firmness as is achieved by the springs described hereinabove. Or as yet another alternative, the differing firmness zones may be achieved by differing pressures in an air mattress as described in U.S. Pat. No. 4,982,466.

Whether the zoned mattress core 12 is a spring mattress or a urethane foam mattress or an air mattress or some other type of mattress core, it should be at least seven inches, and preferably, eight inches in height and sufficiently soft and pliant that it will allow an average man (approximately 5' 9" in height and 160 pounds in weight) or an average woman (approximately 5"3" in height and 120 pounds in weight) to sink as much as five inches into the mattress core at the deepest point of penetration when lying on their side. Thereby, a person reclining atop the mattress sinks into the mattress to a sufficient depth to maximize the area over which the body is supported and thereby minimizes the surface pressure imparted to the body at any point on the body by the mattress.

The invention of this application incorporates a unique mattress cover 14, including a unique topper pact 13 on the top surfaces of the mattress core 12. The cover 14 is so constructed as to permit the transfer of forces from the top of the mattress through the topper pad 13 into the mattress core 12 with a minimum of interference by the covering materials on the mattress core and a minimum transfer of load or pressure laterally of the core or from one zone to another longitudinally.

Figure 3:
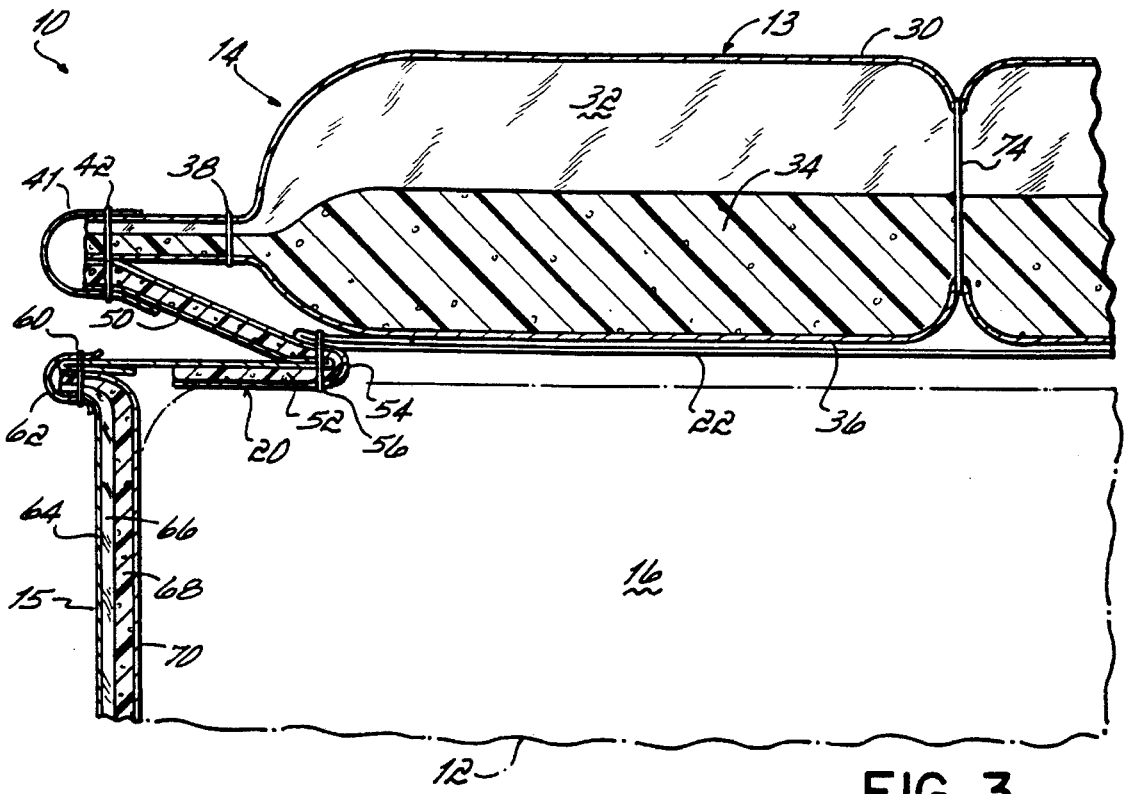
FIG. 3 is a cross sectional view taken on line 3—3 of FIG. 1.
Figure 4:
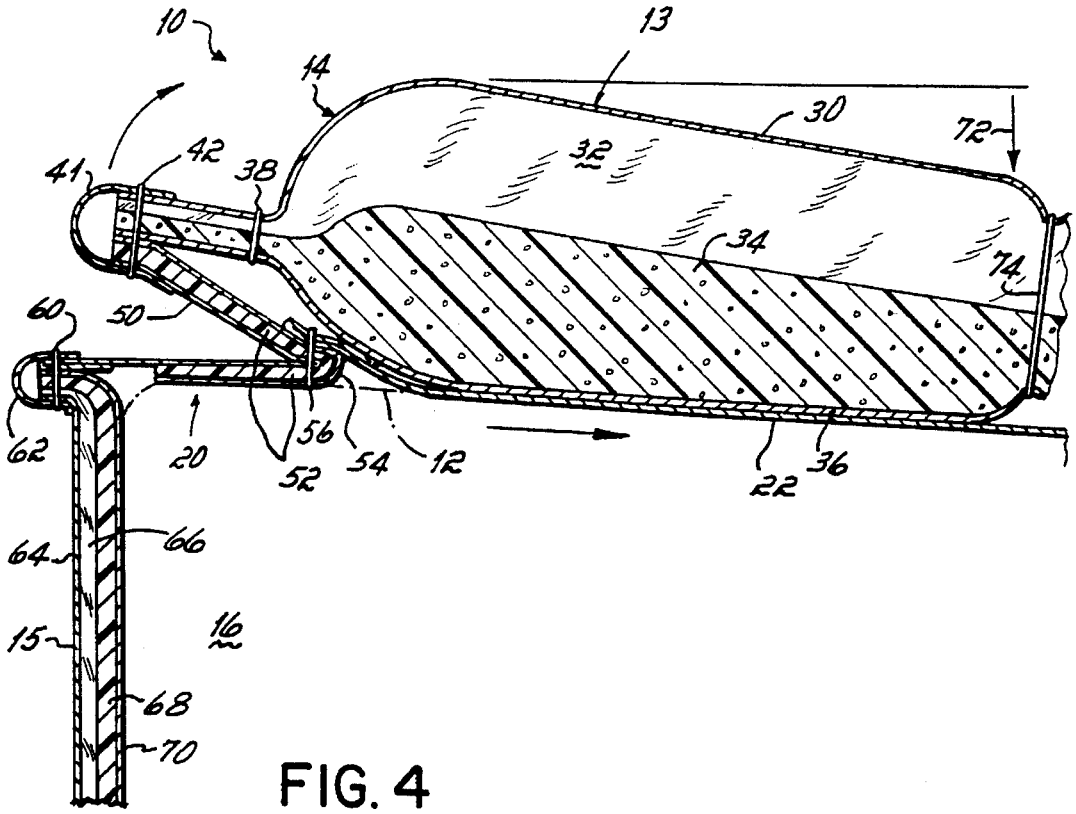
FIG. 4 is a view similar to FIG. 3, but illustrating vertical loading of the mattress such as is imparted to the mattress when a person is reclining atop the mattress.

With particular reference now to FIGS. 3 and 4, it will be seen that the mattress cover 14 comprises a topper pad 13 having a top ply of ticking material 30 connected via an accordion pleat or fold 20 to the top edge of the side 15 and end panels 16, respectively, of the mattress cover 14. Between the bottom of the quilted covering topper pad 13 and the top of the mattress core 12, there is an elasticated fabric which is sewn at its edges to the inner edge of the accordion pleat 20. This elasticated fabric 22 is so constructed as to be stretchable in at least two mutually perpendicular directions, and in the preferred embodiment, is capable of being stretched in any direction. As a consequence of this construction, and as explained more fully hereinafter, the mattress cover 14 enables the non-stretchable ticking and scrim of the cover to fold inwardly when a load or force is applied to the top of the mattress cover 14 while the elasticated fabric 22 stretches. Thereby, compression of the cover 14 can be localized atop the mattress cover 14 without causing hammocking of the covering materials, which hammocking would result in lateral and longitudinal redistribution of the load or force applied to the top of the mattress 10. As a result of this construction of the cover, the function of the posturized mattress core 12 and the overall comfort of the mattress 10 is maintained and enhanced by the covering materials rather than being impaired or effectively destroyed by those covering materials.

The topper pad 13 comprises the top ply of conventional woven ticking material 30, a second ply of non-woven batting material 32, a third ply of urethane foam 34, and a fourth ply of backing scrim material 36. The top ticking layer 30 is a conventional decorative fabric material. In the preferred embodiment, the second ply is a non-woven batting of polyester fibers, but this second layer could as well be a soft urethane or other foamed plastic material. Alternatively, the second and third ply could be a single ply of cushioning urethane foam material. The bottom ply 36 of backing scrim material may be either a woven or unwoven material. It functions solely as a backing to facilitate quilting of the topper pad. These four plies are sewn together approximately 1" inwardly from the outer edge of the materials by a sewn seam 38. The exposed edge outside of this seam 38 is hidden by a decorative tape or covering material 41. The covering tape 41 is a decorative tape which functions solely to cover the outer edge of the topper pad 13 and the free edge of the side and end panels 15, 16. At its outermost edge, the topper pad 13 is connected by a sewn seam 42 to the accordion fold or pleat 20 which interconnects the outer edge of the topper pad 13 to the top edge of the side panels 15 and end panels 16.

The accordion fold 20 is formed by a folded outer ply of decorative woven material 50 to the inside surface of which there is bonded a thin ply of urethane foam 52. Additionally, there is a scrim tape 54 on the inside of the foam ply which interconnects the outer edge of the elasticated fabric 22 to the outer edge of the topper pad 13. This tape scrim 54 may be either a woven or unwoven fabric.

A sewn seam 56 passes through the inner folded edge of the accordion pleat 20 and the outer edge of the stretch fabric 22 so as to form the pleat and simultaneously connect the inner edge of the scrim tape 54 to the outer edge of the elasticated fabric ply 22.

At its outer lower edge, the accordion folded pleat 20 is sewn to the top edge of the side panels 15 and end panels 16 by a seam 60. This seam also connects a decorative tape 62 to the top edge of the side and end panels and the lower edge of the accordion fold 20 so as to cover that edge with a decorative material.

Each of the side panels 15 and end panels 16 comprise a decorative woven fabric outer ply 154, a thin second inner ply 66 of non-woven fabric batting material, a third relatively thin ply of urethane foam material 68, and an innermost ply of woven or unwoven scrim material 70. The seam 60 passes through all four of these plies at the top edge of the side 15 and end panels 16 so as to secure all four of those plies to the lower edge of the accordion fold or pleat 20.

At its lower edge, each of the side and end panels 15 and 16, respectively, has a zipper connection to the bottom panel 17 such that the bottom panel may be secured to the side and end panels by the zipper 18 (FIG. 2). The bottom panel is a single ply of woven or non-woven material which simply functions to hold or secure the mattress cover over the mattress core.

With reference to FIG. 4, it will be seen that when the mattress 10 employing the unique cover 14 of this invention is deflected downwardly by a body or force shown by directional arrow 72 acting upon the top of the mattress, that force or pressure will pass through the cushioning mattress topper pad 13 without causing the topper pad or the non-stretchable fabric layers 30, 36 of the pad to hammock and redistribute the downward force on the pad. This occurs because the accordion pleat 20 allows the non-stretchable materials of the topper pad to move inwardly as the accordion pleat 20 opens (compare FIG. 3 to FIG. 4), and the stretchable elasticated fabric 22 stretches. Thereby, there is no lateral or longitudinal displacement of the vertically downwardly directed force from the top of the mattress pad through to the top of the mattress core 12. In this way, the mattress core can be relatively soft so as to allow a person resting atop the mattress to sink into the mattress a substantial distance so as to maximize the surface area of the body to which pressure is applied. Thereby, pressure is evenly distributed over the maximum surface of the body and high pressure points or "hot spots" on the body are minimized or eliminated. As explained hereinabove, this results in a person sleeping atop the mattress being substantially more comfortable and less prone to transient arousals caused by movements necessary to relieve excessive prolonged pressure on selected parts or protuberances of the body.

Figure 5:
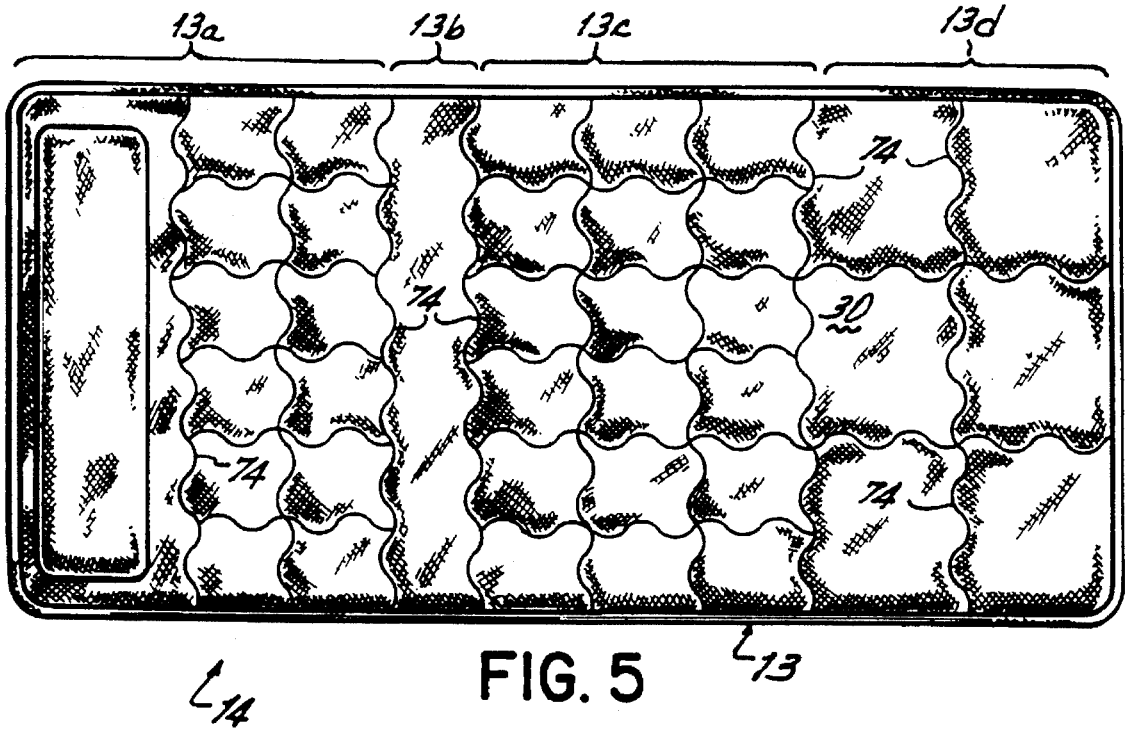
FIG. 5 is a top plan view of the mattress of FIG. 1 illustrating the quilting pattern of the topper pad of the mattress.

With reference to FIG. 5, it will be seen that the topper pad 13 of the mattress 10 has a unique quilting pattern applied thereto. The topper pad is divided into four longitudinal zones **13*a*–13*d* reflecting and identifying the location and the positioning of the four longitudinal zones 12*a*–12*d* of the mattress core located beneath the cover. Thereby, this quilting pattern enables a person sleeping atop the mattress to identify where the waist should be located on the top of the mattress so as to maximize the comfort imparted by the posturized mattress. This quilting pattern also enhances the posturizing support characteristics of the mattress core 12. The closer this quilting pattern, the more it restricts fabric movement, and the greater the restriction to fabric movement, the more firmness imparted to that section of the mattress by the cover. Thus, a close quilting pattern of quilted seams is located over the more firm section 13*a* of the posturized mattress and a looser pattern is located over the less firm section 13*d*** of the mattress.

While we have described only a single preferred embodiment of this invention, persons skilled in this art will appreciate numerous changes and modifications which may be made without departing from the spirit of this invention. Therefore, we do not intend to be limited except by the scope of the following appended claims:

We claim:

1. A mattress cover for covering a resilient mattress core, which mattress cover comprises a top pad, side panels, and end panels;

said top pad comprising a non-stretchable top fabric ply, an intermediate ply of resilient cushioning material, and a bottom stretchable ply;

said non-stretchable top fabric ply being connected to said side and end panels by side walls of substantially vertical height;

said bottom stretchable ply being stretchable in at least two mutually perpendicular directions and connected at its outer edges to said side panels; and said side walls being of non-stretchable fabric material and being of sufficient height, and said bottom stretchable ply being sufficiently stretchable that a load on the top of said cover may substantially depress said cover without hammocking of said top ply and without transferring any appreciable load to said side panels of said cover.

2. The mattress cover of claim 1 wherein said bottom stretchable ply comprises a ply of elasticated fabric material.

3. The mattress cover of claim 1 wherein said intermediate ply of resilient cushioning filler comprises a layer of unwoven fibers.

4. The mattress cover of claim 1 wherein said side walls of non-stretchable fabric material include an inwardly extending accordion folded pleat.

5. The mattress cover of claim 4 wherein said bottom stretchable ply material is connected at its outer edges to an inner edge of said accordion folded pleat.

6. The mattress cover of claim 1 wherein said pad is quilted by a pattern of sewn seams, said sewn seams of said pattern being variably spaced to enhance the posturization of the mattress core over which said mattress cover is intended to be located by positioning more closely spaced quilted seams over more firm sections of the mattress core and more widely spaced seams over less firm sections of said mattress core.

7. A posturized mattress for enhancing sleep by minimizing pressure points on the body of a person sleeping atop the mattress, which mattress comprises:

an elongated mattress core having at least three longitudinally spaced zones of differing firmness, said three zones comprising two end zones and a centermost zone;

a mattress cover encasing said mattress core, said cover including a top pad, side panels, and end panels, said top pad having a non-stretchable top ply of fabric connected to said side and end panels by an accordion folded pleat, said pleat having an inner folded edge located beneath said top pad; and an intermediate ply of elastic woven fiber material stretchable in at least two mutually perpendicular directions connected at its outer edges to the inner edge of said accordion folded pleat.

8. A posturized mattress for enhancing sleep by minimizing pressure points on the body of a person sleeping atop the mattress, which mattress comprises:

an elongated mattress core having at least three longitudinally spaced zones of differing firmness, said three zones comprising two end zones and a centermost zone;

a mattress cover encasing said mattress core, said cover including a top pad, side panels, and end panels, said top pad having a top ply of fabric connected to said side and end panels by an accordion folded pleat having an inner folded edge located beneath said top pad; and an intermediate ply of elasticated stretchable material connected at its outer edges to the inner edge of said accordion folded pleat.

9. The mattress of claim 8 wherein said mattress core is at least seven inches in height and sufficiently soft and pliant so as to permit a person sleeping atop the mattress to sink substantially into the core at the point of deepest deflection so as to minimize pressure applied by the mattress to the body.

10. The mattress of claim 8 wherein said mattress core has at least four longitudinally spaced zones of differing firmness, said zones comprising in sequential order progressing from one longitudinal end thereof, an upper body support zone, a waist support zone, a lower body support zone and a leg support zone, said waist support zone being the most firm of said zones and said leg support zone being the least firm.

11. The mattress of claim 8 wherein said top pad includes at least one ply of cushioning filler material.

12. The mattress of claim 11 wherein said one ply of filler material comprises a layer of urethane foam.

13. The mattress of claim 8 wherein said top pad includes at least one ply of filler material, which one ply is a layer of unwoven fibers.

14. The mattress of claim 8 wherein said top pad is quilted by a pattern of sewn seams, said sewn seams of said pattern being spaced to reflect the location of the differing firmness zones of the mattress core located beneath the pattern of sewn seams of the top pad.

15. A mattress cover for covering a resilient mattress core, which mattress cover comprises:

a top pad, side panels, and end panels, said top pad having a top fabric ply connected to said side and end panels by an accordion folded pleat, said pleat having an inner folded edge located beneath said top pad; and an intermediate ply of elastic woven fiber material stretchable in at least two mutually perpendicular directions connected at its outer edges to the inner edge of said accordion folded pleat.

16. A mattress cover for covering a resilient mattress core, which mattress cover comprises:

a top pad, side panels, and end panels, said top pad having a top ply of fabric connected to said side and end panels by an accordion folded pleat, said pleat having an inner folded edge located beneath said top pad; and an intermediate ply of elasticated stretchable fabric connected at its outer edges to the inner edge of said accordion folded pleat.

17. The mattress cover of claim 16 wherein said top pad includes at least one ply of cushioning filler material, said one ply of filler material comprising a layer of urethane foam.

18. The mattress cover of claim 16 wherein said top pad includes at least one ply of cushioning filler material, said one ply of cushioning material comprising a layer of unwoven fibers.

19. The mattress cover of claim 16 wherein said pad is quilted by a pattern of sewn seams, said sewn seams of said pattern being variably spaced to identify the location and the relative firmness of a plurality of longitudinal zones of a mattress core intended to be positioned beneath said pad.

* * * * *